US005299951A

United States Patent [19]

Blaetz

[11] Patent Number: 5,299,951

[45] Date of Patent: Apr. 5, 1994

[54] HOUSING FOR AN ELECTRICAL CONNECTION

[76] Inventor: Ewald Blaetz, R.D. 1 Box 267, Canajoharie, N.Y. 13317

[21] Appl. No.: 928,972

[22] Filed: Aug. 12, 1992

[51] Int. Cl.[5] ..... H01R 13/62

[52] U.S. Cl. ..... 439/367; 439/587; 439/461

[58] Field of Search ..... 439/312, 320, 323, 367, 439/369, 587, 588, 589, 454, 461

[56] References Cited

U.S. PATENT DOCUMENTS 2,306,821 12/1942 Markey ..... 439/461 X
2,331,409 10/1943 Markey ..... 439/461 X
2,464,893 3/1949 Ross .
3,014,194 12/1961 Berglund .
3,281,755 10/1966 Trager .
3,316,523 4/1967 Trangmar .
3,344,393 9/1967 Hendee .
4,143,934 3/1979 Siebert .
4,580,865 4/1986 Fryberger ..... 439/320 X
4,643,505 2/1987 House et al. .
4,781,617 11/1988 Alibert ..... 439/461
4,911,654 3/1990 Blaetz .
4,998,891 3/1991 Bresko .

*Primary Examiner*—Larry I. Schwartz
*Assistant Examiner*—Khiem Nguyen
*Attorney, Agent, or Firm*—Schmeiser, Morelle & Watts

[57] ABSTRACT

The invention is a housing assembly that is designed to be placed over the coupling area between two power-/extension cords. The assembly includes a two-part central housing in which the two parts are joined together by a quick-release-type coupling that includes a gasket or "O"-ring. At each end of the housing are two threaded end caps. Located at least partially within each end cap is a compressible bushing. The bushings have a central thru-bore through which the power cord passes. As the end caps are tightened onto the housing, the housing contacts and compresses each of the bushings to create a leak-free sealing of the interior of the housing.

15 Claims, 1 Drawing Sheet

HOUSING FOR AN ELECTRICAL CONNECTION

FIELD OF THE INVENTION

The invention is in the field of housings for electrical connections. More particularly, the invention is a housing assembly designed to fit over and protect the electrical connection between two extension cords. The assembly features a central housing that includes two removable end caps. Within each end cap is a two-part bushing that fits around the extension cord and also tightly contacts the interior of the end cap. The bushings act to prevent dirt or moisture from entering the housing.

BACKGROUND OF THE INVENTION

A common problem at construction sites is the lack of accessibility to electrical power throughout the site. Electrical power is normally supplied by the utility company to a single point at the site. From there, power cords in the form of extension cords are run as needed to different locations throughout the site. This leads to the existence of a large number of power cords snaking throughout the area and the cords often become damaged or disconnected.

To protect the coupling area between two extension cords from damage and/or inadvertent disconnection, a number of housing-type devices have been invented that cover the area of the coupling. For examples of such devices, see U.S. Pat. Nos. 2,464,893, 3,281,755, 3,014,194, 3,344,393, 4,143,934, 4,643,505, 4,998,891, or the inventor's prior U.S. Pat. No. 4,911,654.

Prior art protective housings normally comprise a central cylindrical tube that surrounds the coupling area between two extension cords. The tube is normally composed of either one or two parts and includes a fastening structure that unites the housing around the electrical coupling. In some cases, a gasket or plug will be located proximate end portions of the housing to prevent moisture or dirt from entering the housing and affecting the electrical connection.

The prior art protective housings, while accomplishing their intended goals, suffer from certain failings.

One of the primary reasons for using a housing is to prevent water or moisture from reaching the plug and socket connection. In the prior art devices, the design of the seals and how they interact with the housing often results in leakage through the seals. Water can then collect within the housing and cause a short-circuiting of the electrical connection.

The manufacturing costs to produce the prior art devices are prohibitive in most cases. Complicated housing shapes are used that have extremely tight tolerances to achieve the necessary protective qualities of the devices. In addition, the manufacture of most of the prior art housings often entails multi-step machining operations and the joining of dissimilar materials. All of these factors lead to high costs that have made this type of product unsatisfactory for most common usages.

The tight tolerances and complexity of the prior art units also adversely affect their durability. For many devices, after repeated use, the units become difficult to assemble and the worn sealing surfaces further exacerbate any problems with leakage into the housing.

SUMMARY OF THE INVENTION

The invention is a multi-part housing assembly that effectively protects the coupling area between extension cords. The assembly is lightweight, strong, extremely durable, easy to assemble and inexpensive to manufacture. The housing assembly features a two-part central housing that includes a quick disconnect coupling between the two parts.

A tubular end cap is removably engaged to each of the two outer ends of the central housing. Located within each end cap is a two-part removable bushing that fits around the exterior of the extension cord and also contacts the interior surface of the end cap. The bushings interact with the end caps to prevent dirt or moisture from entering the central housing.

The housing and end caps are preferably manufactured from a transparent plastic such as polycarbonate thermoplastic. This material is known for its extremely high strength and durability. These parts may also be manufactured from other high-strength materials such as steel or aluminum.

The removable bushings are preferably manufactured from a resilient, compressible or semi-compressible material such as rubber or nylon. Each bushing is preferably molded in two separate parts with each part being the mirror image of the other. Each bushing-half includes complementary joining structures that ensure the proper mating of the two halves and prevent the formation of leak paths through the assembled bushing.

A first objective of the invention is to provide a lightweight housing that can fully protect the coupling area between two extension cords.

A second objective of the invention is to provide a housing for an electrical connection that is inexpensive to manufacture and is highly durable.

A third objective of the invention is to provide a housing for an electrical connection that will prevent dirt or moisture from contacting the connection yet allows easy and fast uncoupling of the connection should the need arise.

A fourth objective of the invention is to provide a housing for an electrical connection that can be adapted to fit different sizes of power cords.

DETAILED DESCRIPTION OF THE DRAWINGS

Figure 1:
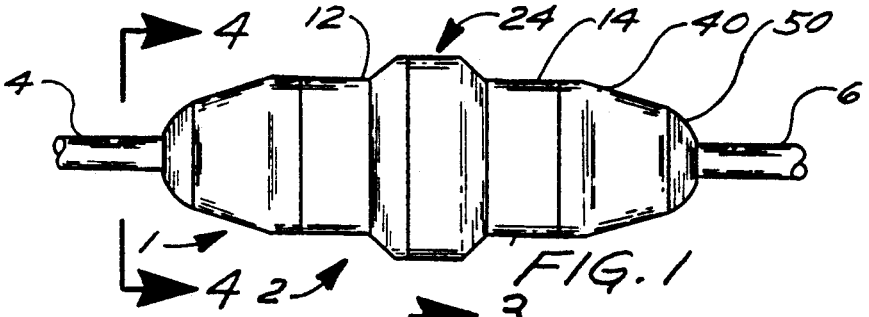
FIG. 1 provides a side view of a housing in accordance with the invention mounted over the connection between two extension cords.

Referring now to the drawings in greater detail, wherein like reference characters refer to like parts throughout the several figures, there is shown by the numeral 1 a housing assembly in accordance with the invention.

Figure 2:
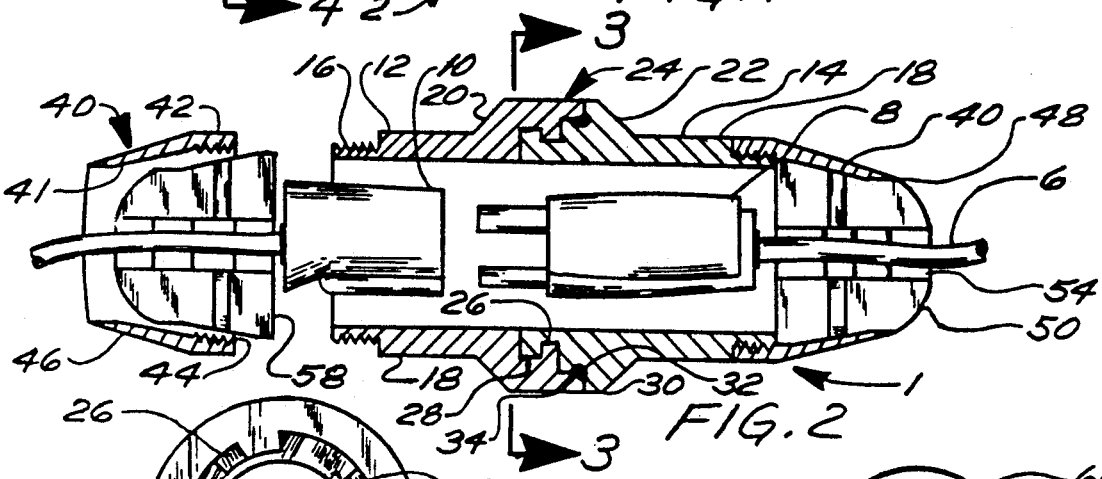
FIG. 2 provides a cross-sectional enlarged view of the housing and extension cords shown in FIG. 1 with one end cap disconnected from the main housing.

In FIG. 1, the housing assembly is shown located about the coupling point of two extension cords 4 and 6 respectively. FIG. 2 provides a cross-sectional view of the assembly and the power cords shown in FIG. 1 wherein the connection between the two power cords can be seen with plug 8 located within socket 10.

The housing assembly is composed of a central housing 2 having two main portions, 12 and 14. Each main portion is in the form of a hollow cylinder that has exterior threads 16 on its distal end 18. The main portions are typically one to three inches in diameter and are approximately two to four inches in length. The two housing portions 12 and 14 are joined together at their inner ends 20 and 22 respectively by a quick-release type connection 24. In FIG. 2, it can be seen that the two housing portions are substantially identical except for the specific structure that forms the connection.

Figure 3:
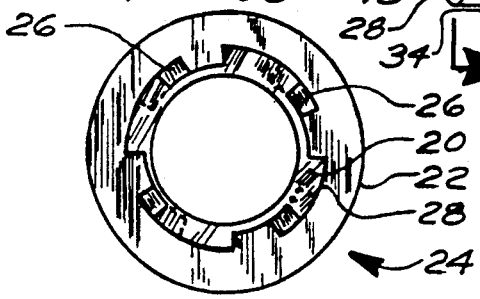
FIG. 3 is a view partly in cross-section taken on the plane indicated by the line 3—3 of FIG. 2 and looking in the direction of the arrows.
Figure 4:
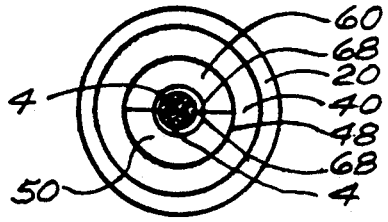
FIG. 4 provides an end view of the housing assembly shown in FIG. 1.

FIG. 3 provides a detailed cross-sectional view in the area of the connection 24 taken at cut 3—3 on FIG. 2. The connection is made by joining ends 20 and 22 and then twisting the two portions relative to each other. The twisting motion causes inwardly extending projections 26 on end 20 to become lodged behind outwardly extending projections 28 on end 22. FIG. 3 shows the interior of the connection once the two portions have been twisted and therefore are in locked engagement. A gasket or "O"-ring 30 is also included in the connection where it is compressed between the outer surface 32 of end 22 and a shaped surface 34 of end 20 to seal the connection.

Attached to the distal end 18 of each of the main housing portions is a tubular end cap 40 having an interior wall 41 that encircles a thru-bore. Each end cap has a cylindrical forward portion 42 that has interior threads 44 that mate with the threads 16 of the main housing portions. The distal portion 46 of each end cap is frusto-conical in shape and has a large aperture 48 located at the extreme end of the end cap. The aperture is concentric with the end cap's longitudinal axis.

Figure 5:
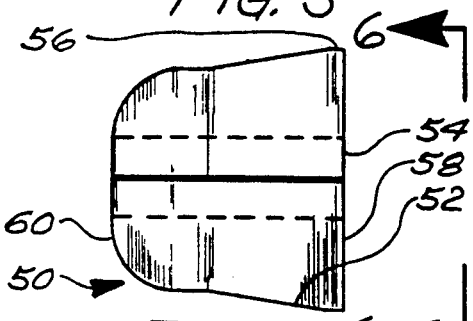
FIG. 5 is a side view of one of the bushings shown in figure 2.
Figure 6:
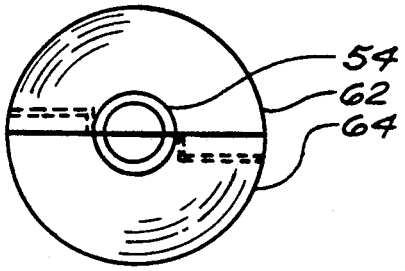
FIG. 6 is an end view of the bushing shown in FIG. 5.

A two-piece bushing 50 is located within each end cap and has the function of sealing the ends of the central housing against the entry of dirt or moisture. FIGS. 5 and 6 provide detailed views of the bushing.

The forward portion 52 of each bushing is frusto-conical in shape and therefore is complementary to the interior of the end cap's distal portion. Extending through the longitudinal center axis of each bushing is a bore 54 through which a power cord such as 4 or 6 may pass. The outer diameter of the bushing's forward end 56 is approximately equal to the outer diameter of the distal portion of end 18 of the housing portions. As shown on the right-hand side of FIG. 2, when a bushing is located within an end cap and the end cap is secured to one of the main housing portions, the front face 58 of the bushing is contacted by end 18 of the housing portion. This causes the bushing to be compressed within the end cap and the distal end 60 of the bushing to extend outwardly through aperture 48 in the end cap. As the bushing is compressed, the diameter of the bushing thru-bore 54 is reduced and the bushing snugly contacts the associated power cord.

Figure 7:
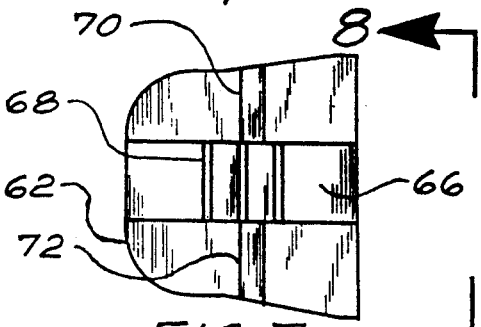
FIG. 7 is a plan view of one of the bushing-halves.
Figure 8:
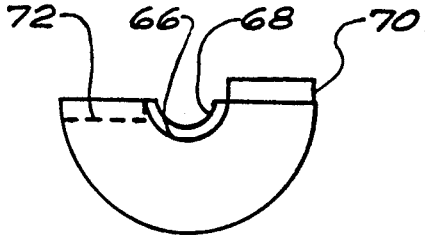
FIG. 8 is an end view of the bushing-half shown in FIG. 7.

As previously noted, each bushing is made up of two substantially identical halves 62 and 64 that include complementary interlocking structure. In FIGS. 7 and 8, one of the halves is detailed. As can be seen, each bushing half has a central groove 66 that forms one-half of thru-bore 54 when the bushing-halves are mated. The groove includes a plurality of semi-circular ridges or fingers 68 that are perpendicular or angled relative to the longitudinal axis of the groove.

The ridges 68 are preferably somewhat flexible so that when the bushing is placed around a power cord, the ridges contact the surface of the power cord to prevent any leakage from occurring through the bore of the bushing. It should be noted that the use of flexible ridges and/or ridges that are angled enables extension cords of different diameters to be received within bore 54 with the bushing still being capable of preventing leakage through the bore. When extension cords of significantly different diameters are used, other bushings having reduced or oversized thru-bores 54 may be substituted.

Located adjacent to groove 66 is an outwardly-extending member 70 that is oriented perpendicularly to the longitudinal axis of the groove. Located on the opposite side of the bushing and also adjacent the groove is a slot or recess 72 that is complementary in shape to member 70. The recess also extends perpendicularly to the longitudinal axis of the groove.

When the two bushing halves are joined, the bushing projections 70 fit within the bushing recesses 72 (shown in FIG. 6) forming a tongue and groove locking structure that prevents relative sliding movement between the two bushing-halves. It should also be noted that the structure and orientation of the tongue and grooves acts to prevent the formation of any leak paths through the bushing when the halves are joined.

To install the housing assembly over the coupling area between extension cords, the cords must initially be separated. The user first places each hollow end cap over the end of one of the two cords being joined and slides it back on the cord. Next, the user attaches the bushings by joining together a bushing pair 50 over the cord proximate the plug (or socket). The end caps are then gently pulled over the bushings.

The two portions of the main housing are initially separated and the user then attaches each to an associated end cap via a mating of threads 16 and 44. The end caps are not tightened against the main housing portions at this point. The user then joins the two extension cords together by inserting the plug into the socket. Next, the two housing portions are mated via connection 24.

The housing assembly now resembles the assembly shown in FIG. 1. The user then tightens each of the end caps onto the main housing. As the end caps move further onto the main housing, the distal ends 18 of the housing portions contact the endfaces 58 of the bushings. This causes the bushings to be compressed and to tightly fit the interior of the end caps as well as to tighten down on the power cord that extends through the center of each bushing. This effectively seals the interior of the main housing against the entry of dirt or moisture. The bushings are sized so that when the end caps are fully threaded onto the main housing, the bushings are compressed the necessary amount to achieve the proper sealing of the housing.

To remove the housing assembly, one reverses the above steps. It should be noted that if the user needs to quickly disconnect the two extension cords, all that is required is to rotate one of the main housing portions relative to the other. This causes the separation of the two halves of the assembly and the plug can then be removed from the socket. If the connection between the power cords is made with some slack cord within the housing, the user will be able to quickly and easily reconnect the two extension cords without having to make any adjustment to the end caps.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A housing assembly for protecting the coupling area between two power cords, said assembly comprising:

a hollow tubular housing having a first end and a second end and formed from first and second portions joined together by a quick-release type coupling means that includes a gasket means;

first and second hollow tubular end caps, said end caps each having a first end and a second end;

first and second compressible bushings, each of said bushings having a central thru-bore and located in a different one of said end caps; and connecting means for connecting the first end of the first end cap to the first end of the housing and the second end of the second end cap to the second end of the housing wherein the connection between the housing and the end caps functions to compress the bushings.

2. The assembly of claim 1 wherein the interior of each end cap is at least partially frusto-conical in shape and wherein the exterior of each bushing is at least partially frusto-conical in shape whereby when the bushings are compressed, the shaped exterior of each bushing is pushed into direct contact with the shaped interior of the associated end cap.

3. The assembly of claim 2 wherein the connecting means comprises interior located threads on the first end of each end cap and complementary exterior located threads on the first and second ends of the housing.

4. The assembly of claim 3 wherein the first end of each end cap is of a first outer diameter and the first and second ends of the housing are of a second outer diameter and wherein the second outer diameter is less than the first outer diameter whereby when the end caps are threaded onto the housing, the first and second ends of the housing can contact the bushings and thereby cause a compression of the bushings within the end caps.

5. The assembly of claim 1 wherein each of said bushings comprises a first half and a second half and wherein each of said halves includes complementary registration means that interfit when the two halves are brought together.

6. The assembly of claim 5 wherein the bushing registration means comprises tongue and groove structures located on each bushing half.

7. The assembly of claim 6 wherein each bushing half includes a first surface that has a centrally located groove and wherein when the bushing halves are joined, the first surface of each bushing half contacts the first surface of the other bushing half whereby the central grooves in the first surface of each bushing half become joined to form the bushing thru-bore.

8. The assembly of claim 7 wherein the central groove in each bushing half includes at least one ridge means oriented at an angle relative to a longitudinal axis of the groove.

9. A housing assembly for protecting the coupling area between two power cords, said assembly comprising:

a hollow tubular housing having a first end and a second end;

first and second hollow tubular end caps, said end caps each having a first end and a second end;

first and second compressible bushings, each of said bushings having a central thru-bore and located in a different one of said end caps and wherein each of said bushings comprises a first half and a second half and wherein each of said halves includes complementary registration means in the form of tongue and groove structures located on each bushing half that interfit when the two halves are brought together and wherein each bushing half includes a first surface that has a centrally located groove that includes at least one ridge means oriented at an angle relative to a longitudinal axis of the grove and wherein when the bushing halves are joined, the first surface of each bushing half contacts the first surface of the other bushing half whereby the central grooves in the first surface of each bushing half become joined to form the bushing thru-bore; and connecting means for connecting the first end of the first end cap to the first end of the housing and the second end of the second end cap to the second cap of the housing wherein the connection between the housing and the end caps functions to compress the bushings.

10. The assembly of claim 9 wherein the housing comprises first and second portions joined together by a coupling means.

11. The assembly of claim 10 wherein the coupling means includes a gasket means and is of the quick-release type.

12. A housing assembly for an electrical coupling wherein said electrical coupling includes a plug having a first diameter and a socket having a second diameter, said housing assembly comprising:

a cylindrical main housing comprising first and second axially-aligned tubular portions joined by a coupling means, said main housing having an open interior and first and second distal ends;

first and second hollow end caps each having a continuous sidewall and first and second ends wherein each of said first and second ends includes a center opening and wherein a thru-bore that is larger in diameter than both the plug and the socket of the electrical coupling extends between the center opening in each end of the associated end cap;

a first connecting means that connects the first end of the first end cap to one of the distal ends of the housing;

a second connecting means that connects the first end of the second end cap to the other of said distal ends of the housing;

a first bushing means formed from at least two separable parts and located at least partially within the first end cap, said first bushing means having a thru-bore;

a second bushing means formed from at least two separable parts and located at least partially within the second end cap, said second bushing means having a thru-bore; and wherein when the housing assembly is to be placed about the electrical coupling, the end caps are removed from the main housing and the plug is passed through the first end cap and the socket is passed through the second end cap and each multi-part bushing is then assembled and placed within the associated end cap to prevent the passage of the plug or socket back through the associated end cap.

13. The assembly of claim 12 wherein when the first and second end caps are connected to the housing, they can be located on the housing in a manner wherein the distal ends of the housing contact the first and second bushing means.

14. The assembly of claim 13 wherein the exterior of each bushing means is complementary in shape to an interior surface of the associated end cap.

15. The assembly of claim 14 wherein each of the bushing means has a tapered exterior surface.

* * * * *